United States Patent [19]

Paterson

[11] 3,977,797

[45] Aug. 31, 1976

[54] APPARATUS FOR DELIVERING FLUID TO A UTILIZATION DEVICE AND A CLOSED LOOP SYSTEM FOR CLEANING SAID APPARATUS AND SAID UTILIZATION DEVICE

[76] Inventor: Peter J. Paterson, 15-17 Denton Place, Brooklyn, N.Y. 11215

[22] Filed: May 6, 1975

[21] Appl. No.: 575,011

Related U.S. Application Data

[63] Continuation-in-part of Ser. No. 489,803, July 22, 1974, abandoned.

[52] U.S. Cl. ..... 401/15; 401/143; 401/188 R; 401/278; 401/197

[51] Int. Cl.[2] ..... A46B 15/00; B44D 3/28

[58] Field of Search ..... 401/143, 188, 278, 13, 401/15, 197, 208

[56] References Cited

UNITED STATES PATENTS

| | | | |
|---|---|---|---|
| 532,645 | 1/1895 | Cushing et al. | 401/149 |
| 1,982,345 | 11/1934 | Kirby | 401/134 X |
| 2,266,354 | 12/1941 | Christenson et al. | 222/318 X |
| 2,631,326 | 3/1953 | Smith | 401/13 X |
| 2,645,524 | 7/1953 | Kelly | 222/148 X |
| 3,143,756 | 8/1964 | Sisko | 401/188 |
| 3,193,868 | 7/1965 | Cassidy | 401/188 X |

FOREIGN PATENTS OR APPLICATIONS

| | | | |
|---|---|---|---|
| 950,444 | 11/1956 | Germany | 401/208 |
| 429,002 | 5/1967 | Japan | 401/133 |

*Primary Examiner*—Lawrence Charles
*Attorney, Agent, or Firm*—Friedman & Goodman

[57] ABSTRACT

The present invention provides a motor driven, helical screw conveyor having an impeller wheel at one end thereof. The screw conveyor is immersed in the liquid to be transferred and lifts the liquid so that the impeller may drive it through a first conduit and a first valve into a utilization device. The valve has three separate positions, the first of which permits delivery of a major portion of the fluid to the utilization device with a minor portion of the fluid being returned to the container via a second conduit. A second position of the first valve provides for flow of fluid from the container, through the first conduit, through the first valve and then directly back to the container via the second conduit. A third position of the valve is utilized with a flexible apron that encloses the utilization device so that when it is desired to clean the apparatus, a cleaning fluid is delivered through the first conduit to the utilization device and outwardly therefrom into the enclosing apron and then through the valve for return to the container via the second conduit. In conjunction with the closed loop cleaning system there is provided a filter that surrounds the helical screw conveyer. Initially the cleaning fluid is contained with the filter and is transported via the conveyer and the two conduits. After passing over the utilization device, the cleaning fluid is discharged onto the inside surface of the cover that supports both the conveyer and the drive motor therefor. The returned cleaning fluid is accumulated in a container and, should it be desired to pass the cleaning fluid through the conveyer and the utilization device for a second time, a valve is opened that permits the cleaning fluid to pass through the filter medium so as to be transported for a second time by the conveyer. The present invention may be used in the non-cleaning mode by inserting the helical conveyer into a paint can, for example, and by releasably clamping the cover that supports the conveyer and the drive motor therefor to the paint can. Alternatively, the present invention may be used with a separate container that includes the filter system with the helical conveyer and the cleaning fluid, the drive motor therefor and with the cover that supports both the helical conveyer and the drive motor being releasably clamped to the container. A carriage having wheels may be provided for supporting the apparatus in either modes of operation.

34 Claims, 8 Drawing Figures

APPARATUS FOR DELIVERING FLUID TO A UTILIZATION DEVICE AND A CLOSED LOOP SYSTEM FOR CLEANING SAID APPARATUS AND SAID UTILIZATION DEVICE

CROSS REFERENCE TO RELATED APPLICATION

The present application is a continuation-in-part application of application Ser. No. 489,803, filed July 22, 1974, for "PAINTING MACHINE", and now abandoned.

BACKGROUND OF THE INVENTION

1. Field of the Invention

This invention relates generally to fluid dispensing apparatus and more particularly to apparatus for delivering fluid to a utilization device and a closed loop system for cleaning the apparatus and the utilization device.

2. Description of the Prior Art

One example of the prior art that is generally related to the present invention is disclosed in U.S. Pat. No. 3,278,975 granted on Oct. 18, 1966. Therein there is disclosed a portable, automatic paint brush that includes a handle having bristles thereon. A paint inlet passage and a paint outlet passage entend axially through the handle and an adjustable valve is positioned in the handle for interconnecting the inner ends of the paint inlet and outlet passages in order to regulate the quantity of paint that circulates through the inlet and outlet passages. The adjustable valve includes a valve chest that is located between the ends of the inlet and outlet passages. Means defining a passage that is operably related to the valve chest and the brush assembly is used for supplying a portion of the circulating fluid, for example, paint, to the brush assembly. A stop valve is operably related to the passage between the valve chest and the brush assembly. A paint pump and a paint tank are connected to the paint inlet and outlet passages.

While the prior art just described is effective, it does exhibit several drawbacks as compared to the present invention. For example, the prior art does not provide means for permitting the pump to run continuously without delivering paint to the brush. Nor does the prior art provide means for delivering a major portion of the paint flow to the brush with a minor portion of the paint flow being simultaneously returned to the source of supply. Perhaps the most readily apparent shortcoming of the prior art is the complete absence of any means for cleaning the system.

SUMMARY OF THE INVENTION

In its broadest aspect, the present invention provides apparatus for discharging a fluid, such as paint of the like from a supply source. A fluid applicator which may be a paint brush or a paint roller includes a handle portion and a dispensing portion. Elongated conduit means are placed in fluid communication with the dispensing portion of the applicator and with the fluid source which may be a can of paint. A helical conveyer together with a cooperating, perforated sleeve that defines a lifting chamber are immersed in the paint. The helical conveyer is provided with an impeller wheel at its upper end for delivering the paint through a first conduit that is in fluid communication therewith to a valve that provides fluid communication with the utilization device. A motor is used for driving the helical conveyer and the impeller wheel. The valve has several positions, one of which permits a major portion of the fluid to be discharged to flow directly to the fluid applicator while a major portion of the fluid is simultaneously returned through the valve and a second conduit to the fluid source without going through the paint applicator. This mode of operation assures continuous agitation or turbulence of the paint so as to prevent the thickening thereof. A second position of the valve provides for a continuous flow of fluid from the container and through the action of the conveyer and the impeller via the first conduit, the valve that is in fluid communication therewith and the second conduit which returns the fluid directly to the container without any portion of the fluid being delivered to the fluid applicator. This second position of the valve assures constant agitation and turbulence of the fluid even when the fluid applicator is not being used.

A third position of the valve is used in conjunction with a closed loop cleaning system. In this second mode of operation the helical screw conveyer, an impeller which together with the drive motor therefor is placed in a container. A filtering system is positioned concentrically about the helical conveyer and is provided with a supply of the cleaning fluid. When the motor is operated the helical conveyer will draw the cleaning fluid through the first conduit, through the valve and the fluid applicator before returning the cleaning fluid to the container. It should be noted that, in this last mentioned mode of operation, a flexible, invertable apron is sealed about the fluid applicator so that the cleaning fluid may be returned via the second conduit to the container without any loss thereof. Should it be desired to recirculate the cleaning fluid once again, an externally operable valve is opened so that the cleaning fluid which has been returned to the container and which is now outside of the filtering system may be delivered to the interior of the filtering system so that the cycle may be repeated. A shut-off valve is also provided to prevent the delivery of any fluid to the applicator.

In an alternative embodiment of the present invention, the fluid applicator is in the form of a paint roller having an articulated joint intermediate the handle portion and the dispenser portion thereof. The articulated joint in the second embodiment of this invention includes clamping means for retaining the dispensing portion or roller portion at a predetermined angle with respect to the handle.

Accordingly, it is an object of the present invention to provide an improved dispensing apparatus for discharging a fluid, such as paint or the like, from a supply source.

It is a further object of the present invention to provide apparatus, as described above, that may be used in either a fluid applying mode of operation or in a closed loop, cleaning mode of operation.

Another object of the present invention is to provide apparatus, as described above, utilizing a motor driven helical screw conveyer in combination with an impeller wheel and conduit means for delivering fluid to an applicator.

A further object of the present invention is to provide valve means, as described above, that permits the fluid to flow along a divided path wherein a portion of the fluid is directed to the applicator while the remaining portion of the fluid is returned to the fluid source.

Still another object of the present invention is to provide valve means, as described above, wherein the fluid applicator may be completely bypassed while maintaining a continuous flow of fluid away from and towards the supply source to provide for a constant agitation or turbulence of the fluid in the container.

Yet another object of the present invention is to provide apparatus, as described above, wherein an apron is included that sealingly encloses the fluid applicator so that the valve means may be operated to permit cleaning fluid to flow from the supply source, through the applicator and then to be returned to the supply source.

A further object of the present invention is to provide a filtering system in conjunction with a third position of the valve means whereby the helical conveyer, the impeller, the conduits, the valve means and the applicator may be cleaned by a continuing flow of the fluid.

Still another object of the present invention is to provide apparatus, as described above, wherein the filtering system is readily changeable.

An additional object of the present invention is to provide apparatus, as described above, wherein the fluid applicator is a paint brush.

Yet another object of the present invention is to provide apparatus, as described above, wherein the fluid applicator is a paint roller.

These and other objects, features and advantages of the invention, will, in part, be pointed out with particularity, and will, in part, become obvious from the following more detailed description of the invention, taken in conjunction with the accompanying drawing which forms an integral part thereof.

BRIEF DESCRIPTION OF THE DRAWING

In the various figures of the drawing, like reference characters designate like parts. In the drawings.

DESCRIPTION OF THE PREFERRED EMBODIMENT

Figure 1:
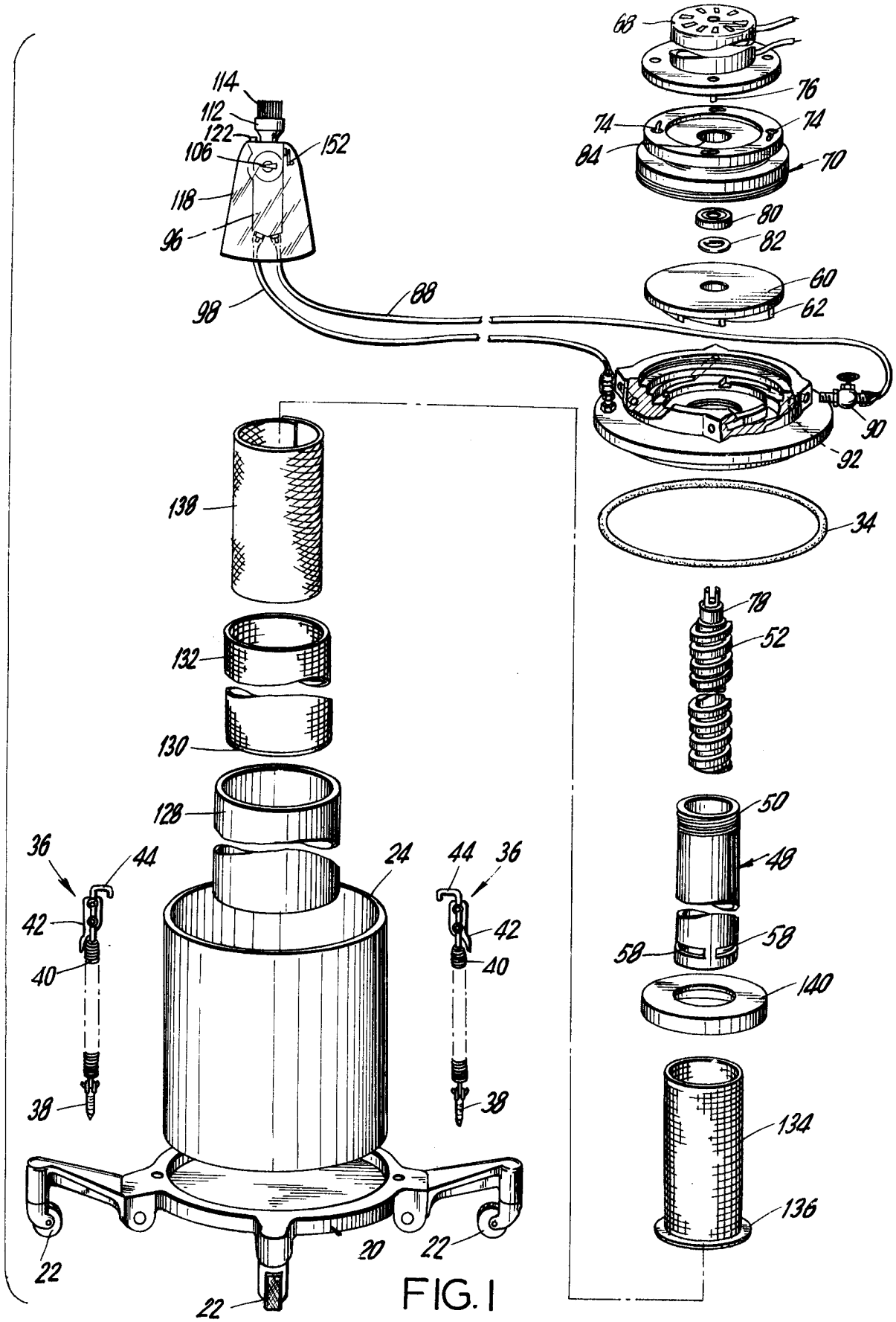
FIG. 1 is an exploded, perspective view, partially in section and partially fragmentary illustrating the components comprising the present invention.
Figure 2:
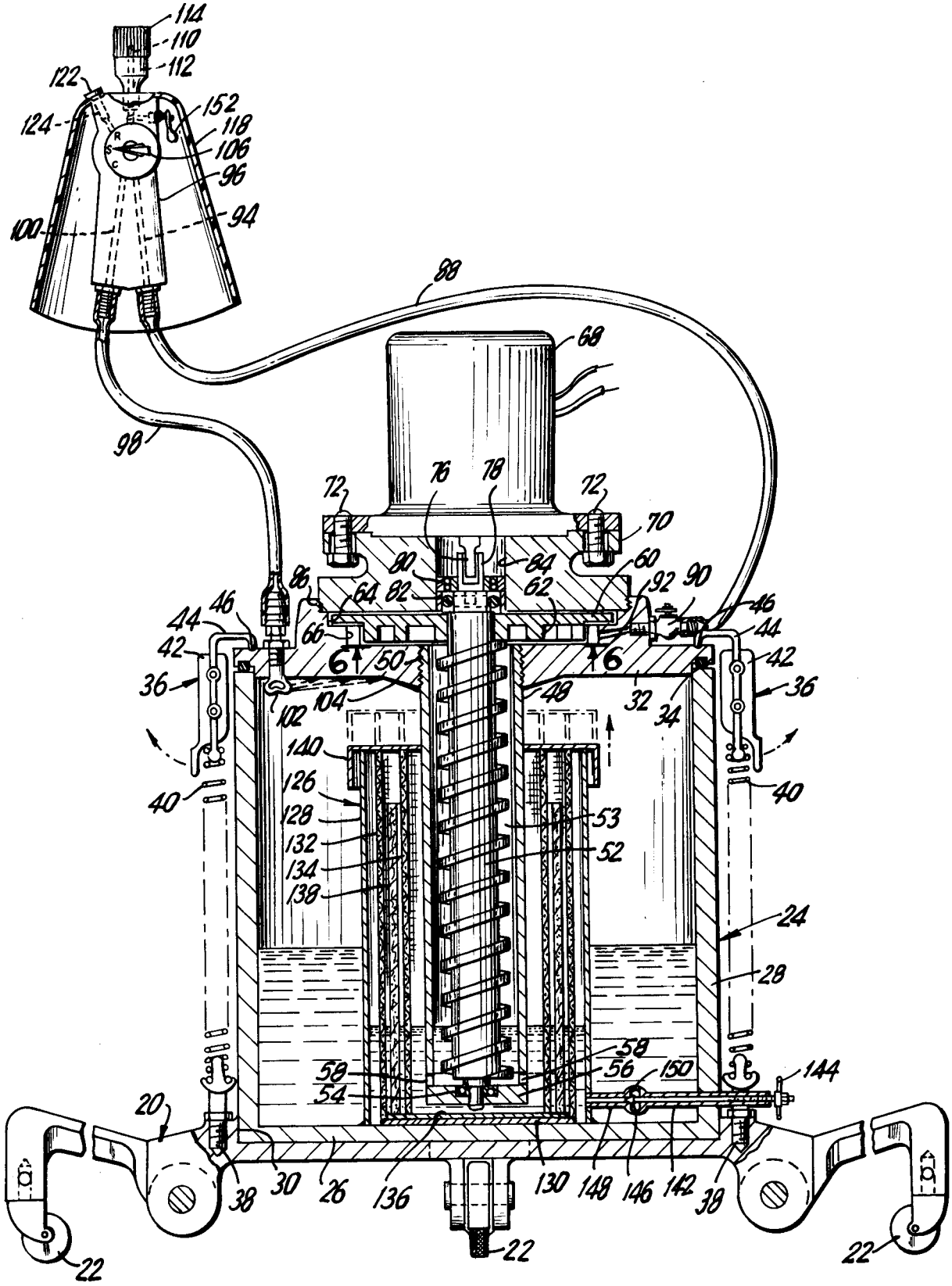
FIG. 2 is an elevational view, partially in section, illustrating the components comprising the present invention shown in FIG. 1 in their assembled form.

Referring now to the drawing, FIGS. 1 and 2 illustrate a first embodiment of the present invention. As shown in FIGS. 1 and 2, the present invention includes a carriage assembly 20 having a plurality of wheels 22 rotatably secured thereto in order to render the present invention fully mobile and portable. There is also shown in FIGS. 1 and 2 a container 24 that is comprised of a basewall 26 and a sidewall 28 extending upwardly therefrom. The container 24 rests on the upper surface of the carriage 20 within a recess 30 therein. It should be understood that the container 24 may be either a paint can or other suitable means for containing a fluid.

A cover generally designated by the reference character 32, is removably mounted on the open, upper end of the sidewall 28 and is sealingly secured thereto by means of an O-ring 34 and a plurality of clamp means which are generally designated by the reference character 36. It will be seen that the clamp means 36 each includes a threaded pin 38 which is suitably secured to the carriage assembly 20. An extension spring 40 extends upwardly from the pin 38 and terminates at its upper end in an overcenter toggle 42 having a latch 44 that is arranged to engage a suitably located recess 46 formed on the upper surface of the cover 32.

Fluid conveyer meanns are provided and are comprised of a tubular column 48 that is threaded into the cover 32 as shown by mating threads 50. A helical screw conveyer 52 is positioned within the column 48 to define a fluid lifting chamber 53 therewith and is journaled at its lower end by means of bearings 54 which are mounted in a transverse end wall 56 at the lower end of the column 48. It should be particularly noted that, while arcuate slots 58 are shown in FIGS. 1 and 2, proximate lower end of the tubular column 48, other forms of openings such as a plurality of circumferentially spaced holes may also be used. The purpose for the openings 58 will be described more fully hereinafter. At its upper end, the helical screw conveyer 52 is provided with an impeller wheel 60 having a plurality of arcuate vanes 62 formed integrally therewith. The impeller wheel 60 may be secured to the upper end of the helical screw 52 by any suitable means such as fasteners, a press fit, etc. The impeller wheel 60 is received in a first counterbored recess 64 formed on the upper surface of the cover 32. The vanes 62 are received in a second bore 66 that is somewhat smaller than the bore 64 but which is still larger than the maximum diameter of the vanes 62.

Drive means for the conveyer 52 are provided in the form of a motor 68 which is secured to a coupling member 70 by means of a plurality of fasteners 72 having arcuate keyhole-shaped slots 74 (FIG. 1). The output shaft 76 of the motor 68 is coupled to a yoke-like terminal 78 that is formed integrally with the upper end of the helical conveyer 52. Bearings 80 provide means for rotatably journaling the helical conveyer 52 at the upper end thereof. In addition, an O-ring 82 is provided within a bore 84 that receives the upper end of the helical screw 52 to provide seal means therefor. It should also be noted that the coupling member 70 is threadably secured to the upper surface of the cover 32 such as shown by the mating threads 86.

A first conduit 88 is in fluid communication with the interior of the container 24 by means of a shut-off valve 90 and a passageway 92 that is formed in the cover 32. The valve 90 permits a total shutdown of the entire system when it is not in use. The opposite end of the first conduit 88 terminates at a fluid inlet passage 94 that is formed in a valve housing 96. A second conduit 98 terminates at one end in a fluid outlet passage 100 that is formed in the valve body 96 and at its opposite end in a nozzle 102 that extends through the cover 32. As shown best in FIG. 2, the nozzle 102 is arranged to direct the returning fluid against the inside surface of the cover 32 which is centrally tapered in a downward direction such as shown by the reference character 104. The purpose for this construction is to assure that the cleaning fluid, on its return, covers a maximum interior surface area of the container 24.

Figure 3:
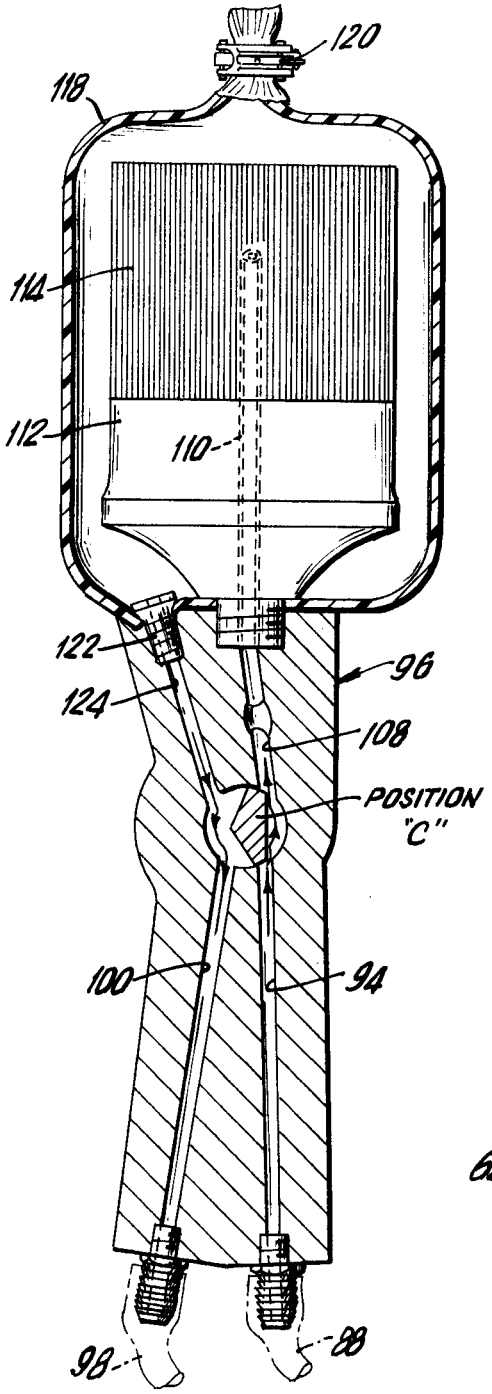
FIG. 3 is an enlarged, sectional view illustrating the valve means and a fluid applicator in the second or cleaning mode of operation.
Figure 4:
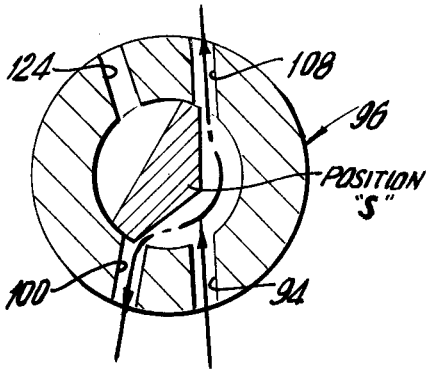
FIG. 4 is an enlarged, sectional view schematically illustrating the valve means comprising the present invention in the mode of operation wherein one portion of the fluid is delivered to the applicator while another portion of the fluid is returned to the fluid supply source.
Figure 5:
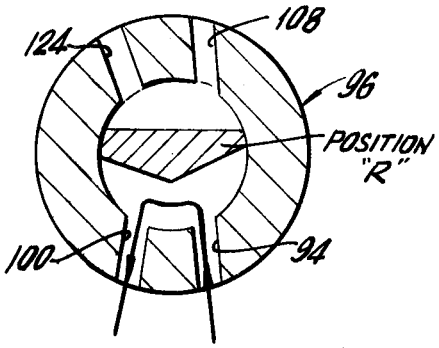
FIG. 5 is a sectional view similar to FIG. 4 illustrating another position of the valve wherein the fluid applicator is completely bypassed and wherein the fluid is delivered from the supply source thereof and is returned directly thereto.
Figure 6:
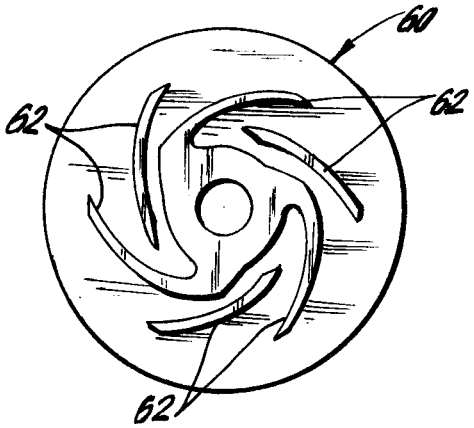
FIG. 6 is a transverse sectional plan view taken along line 6—6 of FIG. 2 illustrating the impeller wheel comprising the present invention.

Turning now more specifically to FIGS. 3, 4 and 5, the construction of the valve 96 will now be described. Referring first to FIG. 4, it will be seen that the valve handle 106 is at the position labeled "S" which provides for a dual flow path of the fluid in the container 24. That is, a first portion which may be the major portion of the fluid will flow through the inlet passage 94 and will exit therefrom through a passageway 108 which is in fluid communication with a tube 110 that extends through a base portion 112 of a fluid applicator which is illustrated as a paintbrush 114. The tube 110 terminates within the bristles of the paintbrush 114. A second or minor portion of the fluid from the container 24 will bypass the paintbrush 114 and will exit from the valve body 96 via the outlet passage 100 before returning through the conduit 98 to the interior of the container 24. The construction just described assures that, while sufficient fluid is normally supplied to the paintbrush 114, a small portion of the fluid will also be returned directly to the container in order to agitate the fluid that remains therein. Additionally, the amount or rate of fluid being supplied to the paintbrush can be adjusted or regulated by increasing or decreasing the amount by which the valve 106 blocks the opening to the passageway 108.

When the knob 106 of the valve 96 is turned to the "R" position, such as illustrated in FIG. 5, the fluid will be prevented from travelling through the passageway 108 and entering the tube 110. Instead, all of the fluid will travel from the inlet passageway 94 directly into the outlet passageway 100 and then be returned to the container via the conduit 98. This position of the valve 96 assures constant agitation of the fluid remaining in the container when the paintbrush is not in use.

The third and final position of the knob 106 is labeled C and represents the cleaning position. In this position, such as illustrated in FIG. 3, it will be seen that the cleaning fluid will travel through the passageways 94 and 108 as well as the tube 110. In order to assure that fluid is not lost, an apron 118 is sealingly secured to the upper end of the valve housing 96. Normally, when the paintbrush is in use, the apron 118 takes the shape shown in FIG. 2. However, when it is desired to clean the system in the manner which will be described more fully hereinafter, the apron 118 is inverted and sealed at its top by means of a clamp 120. A hollow fitting 122 is provided through the base of the apron 118 and is threaded into the valve housing 96. A passageway 124 formed in the housing 96 provides fluid communication between the interior of the apron 118, such as shown in FIG. 3, and the fluid outlet passage 100.

In order to operate in the cleaning mode, a filter system generally designated by the reference character 126 is provided within the container 24 and concentrically about the column 48 and the helical conveying screw 52. The filtering system 126 is comprised of an outer, fluid impervious tubular member 128 that is suitably secured to the basewall 26 of the container 24 such as by welding or the like. A first baseplate 130 rests on the basewall 26 of the container 24 and a first tubular screen 132 extends upwardly therefrom. The tubular screen 132 is rigidly secured to the first baseplate 130 such as by welding or the like. Radially inward of and concentric with the first tubular screen 132 is a second tubular screen 134 which is secured to a second baseplate 136 that rests directly on the first baseplate 130. As shown in FIG. 2 for example, the second baseplate 136 extends radially beyond the second tubular screen 134 in order to support a filter member 138 that is positioned between the first and second tubular screens 132 and 134, respectively. At its upper end and the filter system 126 is provided with an inverted, cup-shaped cap 140 having a central opening to receive the column 48. The cap 140 is rigidly secured to the top end of the second, inner tubular screen 134. It will be appreciated that, when the cover 32 is removed, together with the helical conveyer 52 and the motor 68, the cap 140 may be raised to the position shown in phantom outline in FIG. 2. When the cap 140 is raised the laterally extending flange of the second baseplate 136 will lift the filter member 138 so that the filter member 138 may be easily removed. Initially, the filter member 138 is set in place outside of the container 24 by being wrapped about the outside surface of the second, inner tubular screen 134. Thus, when the cap 140 is put into place, the filter member 138 will be positioned between the first and second tubular screen 132 and 134, respectively, and will be supported thereby.

The tubular member 128 is provided with a valve 142 that provides fluid communication between the interior of the tubular member 128 and the interior of the container 24. The valve 142 extends through the sidewall 28 of the container 24 and is operable by means of an external handle 144. When the valve 142 is in the closed position the gate 146 thereof will plug the body portion 148 as shown in FIG. 2. When the valve 142 is in the open position the gate 146 will be retracted and an opening 150 that is formed in the body portion 148 will provide the required fluid communication between the interior of the container 24 and the interior of the cylinder 128.

When the system is in the S position and the motor 68 is operating, a shut-off valve 152 (FIG. 2) closes down the passageway 108 formed in the valve body 96, so that no fluid is supplied to the paintbrush 114. This permits the operator to take a break without changing the setting of the knob 106 which regulates the supply rate of the fluid to the paintbrush.

Figures 7, 8:
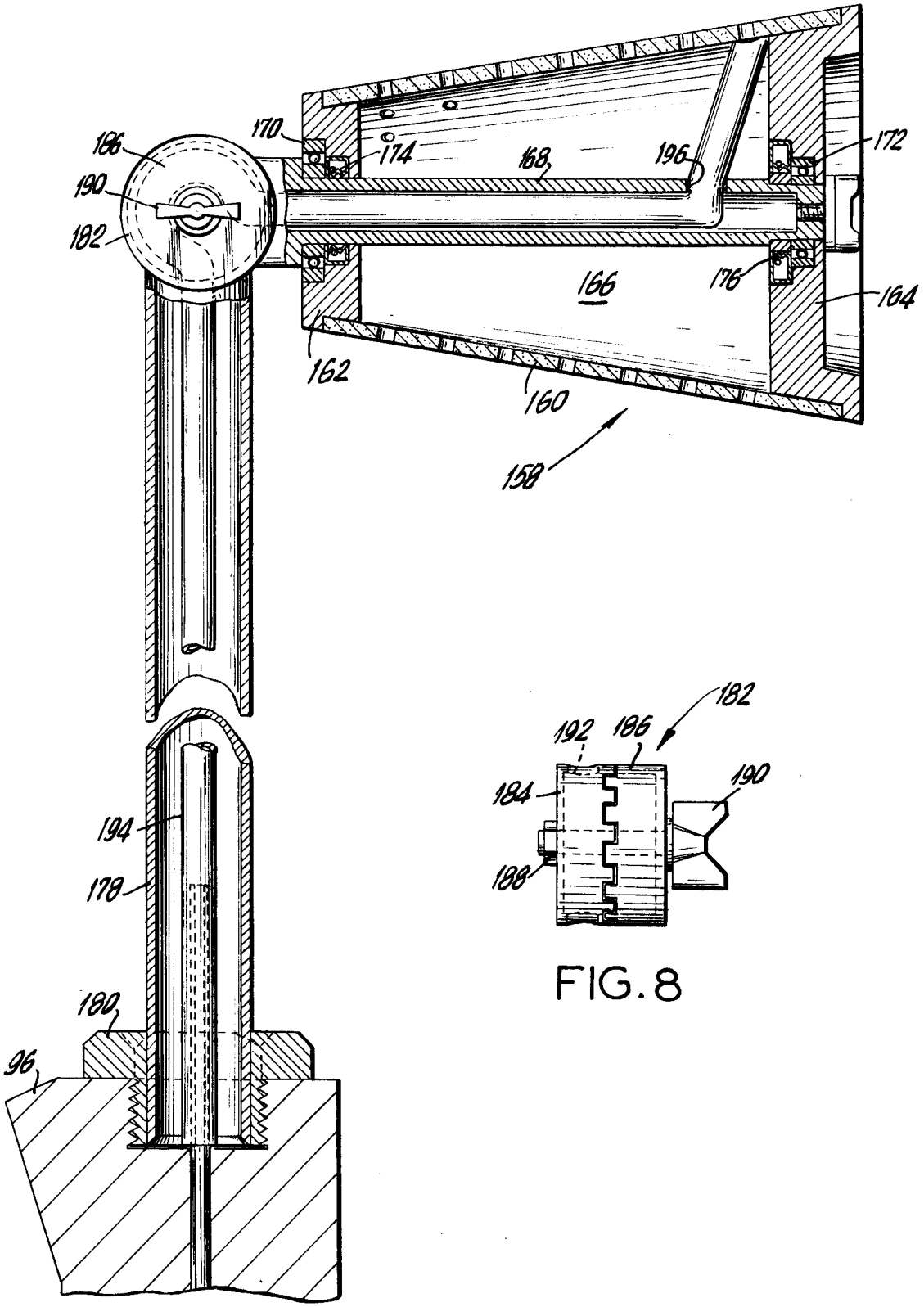
FIG. 7 is a fragmentary, sectional view illustrating an alternative form of applicator comprising the present invention.
FIG. 8 is a detailed view of the articulated joint that is used in conjunction with the second embodiment of the fluid applicator comprising the present invention.

An alternative embodiment of the present invention is disclosed in FIGS. 7 and 8. Therein, instead of a paintbrush, a paint roller 158 is shown having a rotatable conical, perforated body portion 160 and end walls 162 and 164 which in combination define a fluid reservoir 166. A hollow spindle 168 is journaled in the end walls 162 and 164 by means of bearings 170 and 172 respectively so that the conical portion 160 can rotate with respect to the spindle 168. Seal means 174 and 176 are also provided in the end walls 162 and 164, respectively. A handle portion 178 is secured to the valve body 96 by means of a nut 180 that is welded to the handle portion 178 and which is threadably secured to the valve body 96.

An articulated joint 182 couples the handle portion 178 and the body portion 160 of roller 158. It will be seen for example in FIG. 8 that the articulated joint 182 is comprised of first and second sections 184 and 186 that have mating teeth on their confronting faces. Clamping means in the form of a threaded nut 188 and a wing stud 190 are used to maintain the sections 184 and 186 of the articulated joint 182 in any desired position whereby the axis of the spindle 168, and therefore the conical portion 160, may be set at any desired angle with respect to the axis of the handle portion 178. The articulated joint section 184 is also provided with two openings 192 that permit the passage of a tube 194 through the handle portion 178 and the spindle 168 such as shown in FIG. 7. The tube 194 fits over of the tube 110 mentioned above. The tube 194 exits from the spindle 168 through an opening 196 and terminates proximate the inside surface of the conical portion 160. The remaining structural portion and function of the second embodiment is the same as described in connection with FIGS. 1–6 so that the description thereof need not be repeated. However, it should be noted, that the apron 118 described in connection with the first embodiment may also be applied to the second embodiment so that the cleaning function is available therefor.

It will be appreciated from the foregoing that an improved apparatus for delivering fluid from a supply source to a utilization device has been provided. The valve means described hereinbefore provide means for either permitting a divided flow of fluid to the utilization device and back to the container or a complete bypass of the utilization device whereby the fluid flows from the container and then directly back in order to assure agitation of the fluid in the container. In the cleaning mode of operation the valve permits flow of fluid from the container through the utilization device which is sealed by means of an invertable apron so that the cleaning fluid returns to the container. Should it be desired to recycle the cleaning fluid another valve means may be opened so that the fluid may flow through a filter member prior to its being delivered by means of a screw conveyer and impeller wheel back to the utilization device.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. Apparatus comprising:

a. a container for holding a supply source of fluid, said container including an end wall and an axially elongated sidewall extending upwardly therefrom;

b. fluid conveyer means having an end portion positioned below level of the fluid in said container;

c. a motor drivingly coupled to said conveyor means;

d. first elongated conduit means having a first end in fluid communication with said conveyor means, said first conduit means defining a first passageway for removing fluid from said container;

e. second elongated conduit means having a first end in fluid communication with interior of said container, said second conduit means defining a second passageway for returning fluid to said container;

f. a first, multi-position valve means in fluid communication with a second end of both said first and second conduit means, said first valve means being adapted to transfer fluid from the source through a first position thereof and to return at least a portion of the fluid to the source at said first position thereof, said first valve means further having a second position so that the fluid flow from the source, through said first conduit means, through said first valve means in said second position thereof, and back to the source via said second conduit means;

g. a utilization device in fluid communication with said first valve means, said utilization device having a dispensing portion;

h. a cover sealingly mounted on said container; and i. said first end of said second conduit means including a nozzle for directing the returned fluid against an inwardly facing surface of said cover.

2. The apparatus according to claim 1 wherein there is further included a second, shut-off valve means interposed between said first valve means and the utilization device.

3. The apparatus according to claim 1 wherein said apparatus further comprises a carriage for removably supporting the container.

4. The apparatus according to claim 1 wherein there is further included means for mounting said conveyor means and said motor on said cover.

5. The apparatus according to claim 1 wherein there is further included means for releasably retaining said cover on the container.

6. The apparatus according to claim 5 wherein said retaining means comprises spring biased latching means.

7. The apparatus according to claim 1 wherein said conveyor means comprises an elongated, helical screw adapted to be immersed in the fluid whereby rotation of said screw by said motor causes the fluid to be directed towards said first conduit means.

8. The apparatus according to claim 7 wherein said conveyor means further comprises an impeller wheel that is rotatable together with said screw, said impeller wheel having a plurality of vanes that are adapted to direct the fluid towards said first conduit means when said screw is rotated.

9. The apparatus according to claim 1 wherein said ulitization device is a paintbrush having a handle portion intermediate said dispensing portion and both said conduit means.

10. The apparatus according to claim 1 wherein said utilization device is a hollow paint roller having a tubular handle portion intermediate said dispensing portion and both said conduit means whereby said container is in fluid communication with said paint roller.

11. The apparatus according to claim 10 wherein there is further included an articulated joint intermediate said handle portion and said dispenser portion.

12. The apparatus according to claim 11 wherein there is further included clamp means for retaining said articulated joint at a preselected position.

13. Apparatus comprising:

a. a container for holding a supply source of fluid, said container including an end wall and an axially elongated sidewall extending upwardly therefrom;

b. fluid conveyor means having an end portion positioned below level of the fluid in said container;
c. a motor drivingly coupled to said conveyor means;
d. first elongated conduit means having a first end in fluid communication with said conveyor means, said first conduit means defining a first passageway for removing fluid from said container;
e. second elongated conduit means having a first end in fluid communication with interior of said container, said second conduit means defining a second passageway for returning fluid to said container;
f. a first, multi-position valve means in fluid communication with a second end of both said first and second conduit means, said first valve means being disposed in a valve housing and adapted to transfer fluid from the source through a first position thereof and to return at least a portion of the fluid to the source at said first position thereof, said first valve means further having a second position so that the fluid flows from the source, through said first conduit means, through said first valve meanns in said second position thereof, and back to the source via said second conduit means;
g. a utilization device connected to said valve housing and in fluid communication with said first valve means, said utilization device having a dispensing portion;
h. a flexible, invertable apron positioned about and secured to said valve housing;
i. means for securing said apron about said utilization device in an inverted position; and
j. said first valve means including a third position so that said fluid is directed from said container to said utilization device via said first conduit means, then from said utilization device back to said container via said second means when said apron encloses said utilization device in said inverted position.

14. The apparatus according to claim 13 wherein there is further includes a cover sealingly mounted on said container.

15. The apparatus according to claim 14 wherein there is further included means for releasably clamping said cover to said container.

16. The apparatus according to claim 15 wherein said clamping means comprises spring biased latching means.

17. The apparatus according to claim 14 wherein there is further included means for releasably mounting said conveyor means on said cover.

18. The apparatus according to claim 14 wherein said first end of said second conduit means includes a nozzle for directing the returned fluid against the inwardly facing surface of said cover.

19. The apparatus according to claim 13 wherein said conveyor means comprises an elongated helical screw adapted to be submerged in the fluid whereby rotation of said screw by said motor causes the fluid to be directed towards said first end of said first conduit means.

20. The apparatus according to claim 18 wherein said conveyor means further comprises an impeller wheel that is rotatable together with said screw, said impeller wheel having a plurality of vanes that are adapted to direct the fluid towards said first end of said first conduit means when said screw is rotated.

21. The apparatus according to claim 13 wherein there is further included a second, shut-off valve means interposed between said first valve means and said utilization device.

22. The apparatus according to claim 13 wherein there is further includes a carriage for removably supporting said container.

23. The apparatus according to claim 13 wherein said utilization device is a paintbrush having a handle portion intermediate said dispensing portion and said first and second conduit means.

24. The apparatus according to claim 13 wherein said utilization device is a hollow paint roller having a tubular handle portion intermediate said dispensing portion and said first and second conduit means wherein said container is in fluid communication with said paint roller.

25. The apparatus according to claim 24 wherein there is further included an articulated joint intermediate said handle portion and said dispenser portion.

26. The apparatus according to claim 25 wherein there is further included clamp means for retaining said articulated joint in a preselected position.

27. The apparatus according to claim 13 wherein said utilization device is a paintbrush having a plurality of bristles and means are included for providing fluid communication between said bristles and said first conduit means.

28. The apparatus according to claim 13 wherein said container further includes a filter system and means for selectively isolating the returned fluid from said conveyor means.

29. The apparatus according to claim 28 wherein said means for selectively isolating the returned fluid from said conveyor means comprises a cylinder surrounding said conveyor means and defining a return fluid annulus in combination with said container, there being further included a third valve means for providing selective fluid communication between said returned fluid annulus and said filter system.

30. The apparatus according to claim 29 wherein said third valve means extends through said sidewall of said container and is operable from an exterior thereof.

31. The apparatus according to claim 29 wherein said filter system comprises a first baseplate positioned on an inside surface of said endwall of said container, a first tubular screen secured to said first baseplate and extending upwardly therefrom within said cylinder, a second baseplate positioned on said first baseplate, a second tubular screen secured to said second baseplate and extending upwardly therefrom, said second screen being within said first screen and defining an annulus space therebetween and a filter member positioned within said annulus space.

32. The apparatus according to claim 31 wherein said filter member is tubular.

33. The apparatus according to claim 32 wherein said second baseplate includes a laterally extending flange and said filter member is supported thereon.

34. The apparatus according to claim 33 further including a cover plate secured to on upper end of said second screen whereby after said conveyor means and said motor are removed, said cover plate, said second screen and said filter member are removable as a unit.

* * * * *